US006005193A

United States Patent [19]

Markel

[11] Patent Number: 6,005,193

[45] Date of Patent: Dec. 21, 1999

[54] CABLE FOR TRANSMITTING ELECTRICAL IMPULSES

[76] Inventor: Mark L. Markel, 6321 N. McKinley Rd., Flushing, Mich. 48433

[21] Appl. No.: 08/915,151

[22] Filed: Aug. 20, 1997

[51] Int. Cl.[6] ..... H01B 7/00

[52] U.S. Cl. ..... 174/117 FF; 174/117 F

[58] Field of Search ..... 174/117 F, 117 FF, 174/113 C, 131 A, 36

[56] References Cited

U.S. PATENT DOCUMENTS

| | | | |
|---|---|---|---|
| 3,439,111 | 4/1969 | Miracle et al. | 174/117 F X |
| 3,505,144 | 4/1970 | Kilduff et al. | 174/117 FF X |
| 3,708,608 | 1/1973 | Wyman | 174/117 F X |
| 3,768,049 | 10/1973 | Priaroggia et al. | 174/131 A X |
| 3,941,966 | 3/1976 | Schatz | 174/117 F |
| 3,968,321 | 7/1976 | Olszewski et al. | 174/36 |
| 4,070,911 | 1/1978 | Makin | 374/208 |
| 4,208,542 | 6/1980 | Endo | 174/113 C |
| 4,662,693 | 5/1987 | Hutter et al. | 439/583 |
| 4,734,544 | 3/1988 | Lee | 174/117 F |
| 4,780,157 | 10/1988 | Coon | 174/117 FF X |
| 4,794,229 | 12/1988 | Goss et al. | 219/548 |
| 5,262,589 | 11/1993 | Kesler | 174/36 |
| 5,268,534 | 12/1993 | Gailey et al. | 174/126.2 |
| 5,374,782 | 12/1994 | Taylor et al. | 174/113 C X |
| 5,393,933 | 2/1995 | Goertz | 174/117 R |

*Primary Examiner*—Kristine Kincaid
*Assistant Examiner*—Chau Nguyen
*Attorney, Agent, or Firm*—Weintraub & Brady, P.C.

[57] ABSTRACT

An electrically conductive cable for transmitting electrical signals is disclosed. In a preferred embodiment, the cable includes a first braided wire conductor having a cross-sectional height and cross-sectional width which is more that twice the cross-sectional height, a first dielectric sheath surrounding the first oval braided wire conductor. The cable also includes a second braided wire conductor which has a cross-sectional height and a cross-sectional width which are substantially identical to those of the first oval braided wire conductor, and a second dielectric sheath surrounding the second oval braided wire conductor. In the preferred cable design, the second oval braided wire conductor is disposed vertically above the first oval braided wire conductor to enhance performance characteristics of the cable. A metallic shielding tube may be provided surrounding the first and second conductors and their respective sheaths. In one embodiment, the conductors are hollow braided metal wire tubes with cross-sectionally oval dielectric insulators disposed centrally therein.

11 Claims, 10 Drawing Sheets

FIG 1
PRIOR
ART
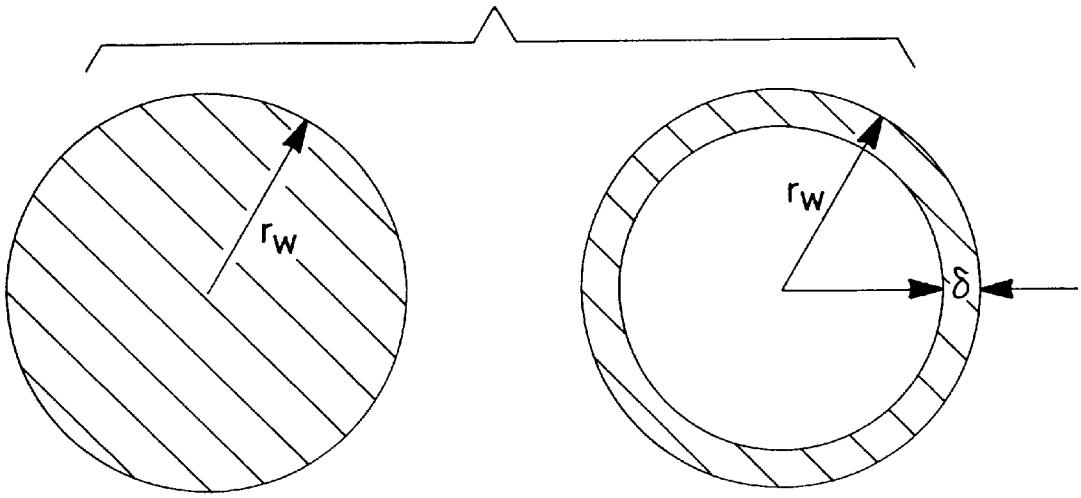
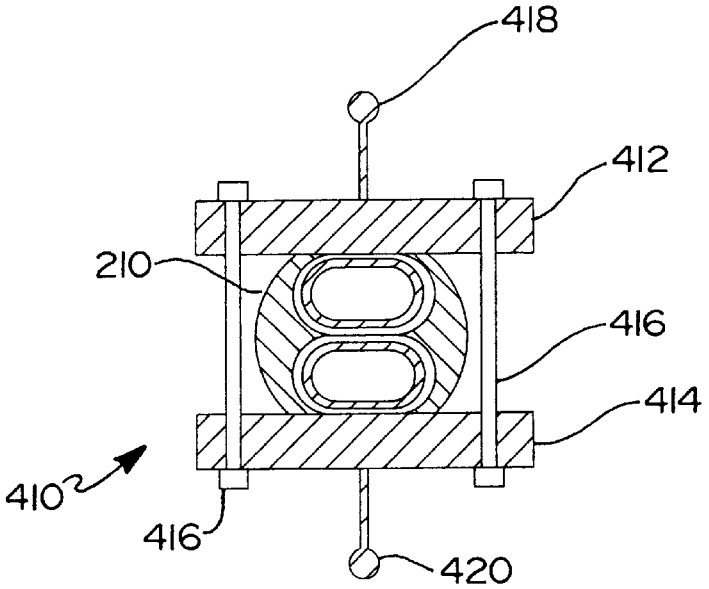
FIG 14

PRIOR
ART

FIG 4
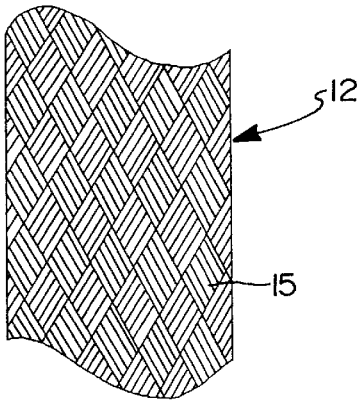
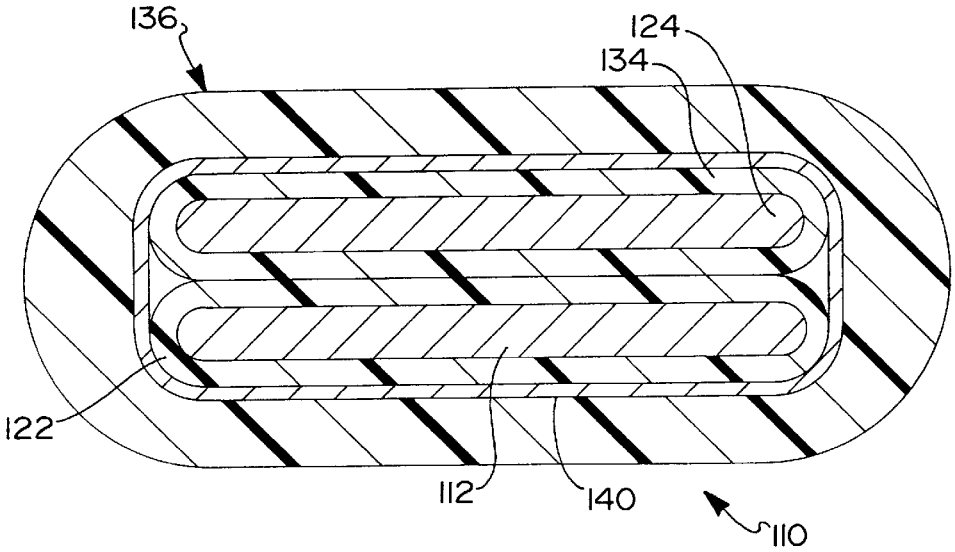
FIG 5

FIG 6
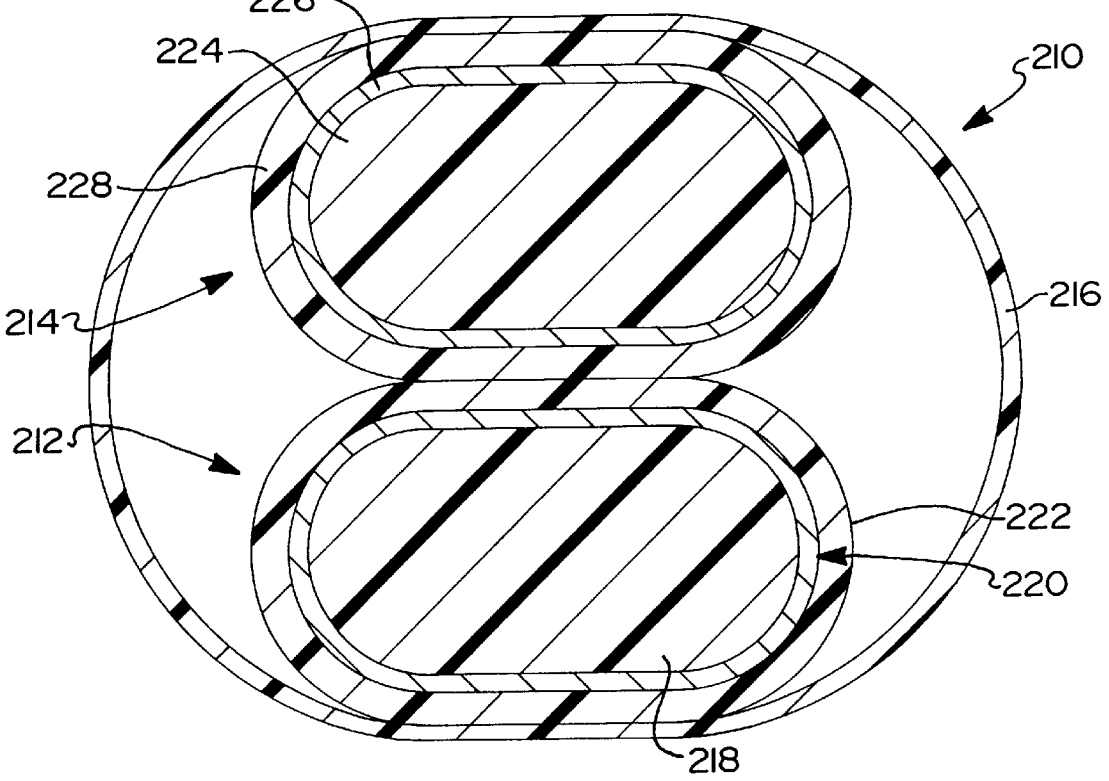
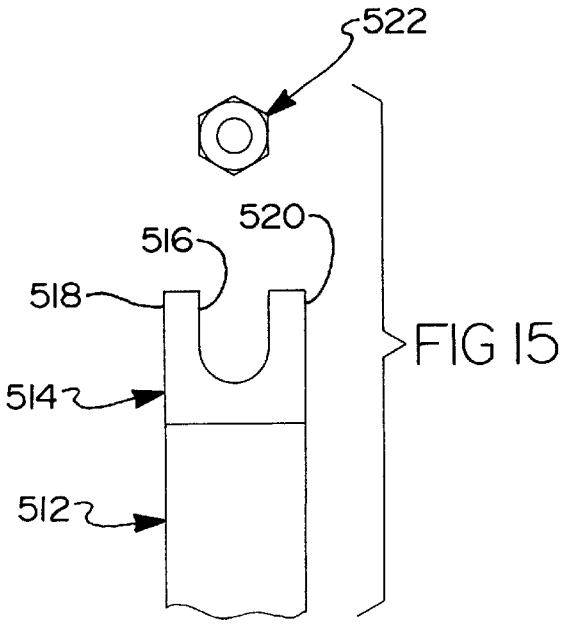
FIG 15

FIG 7
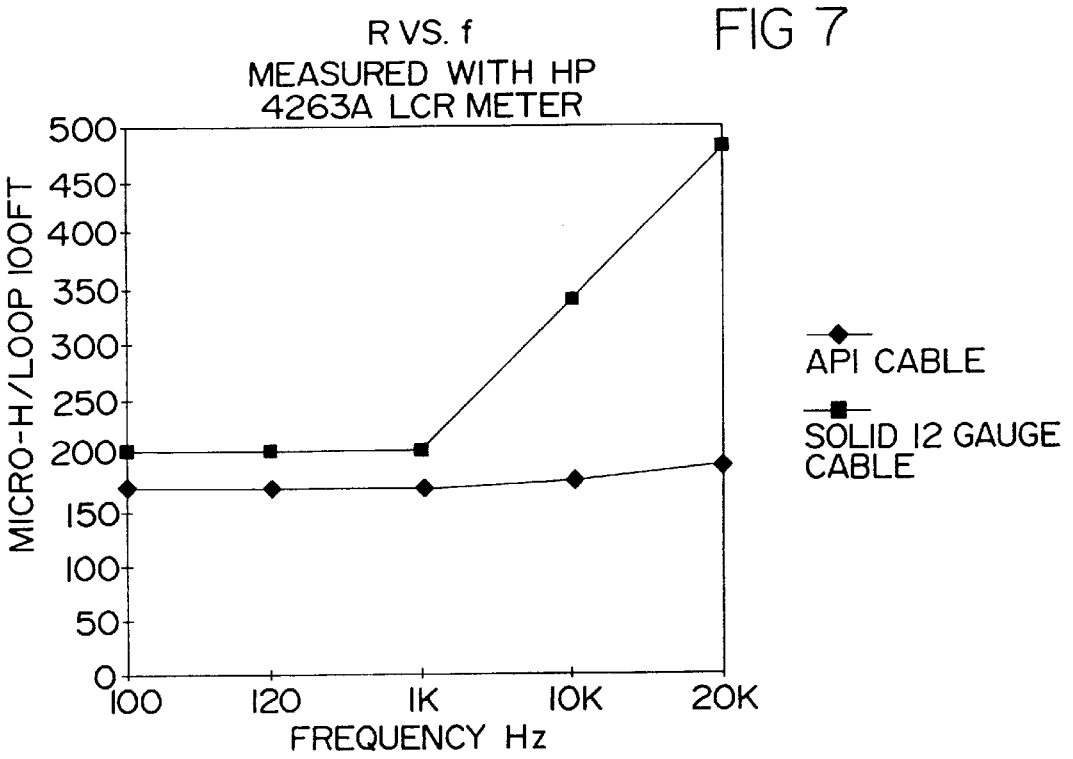
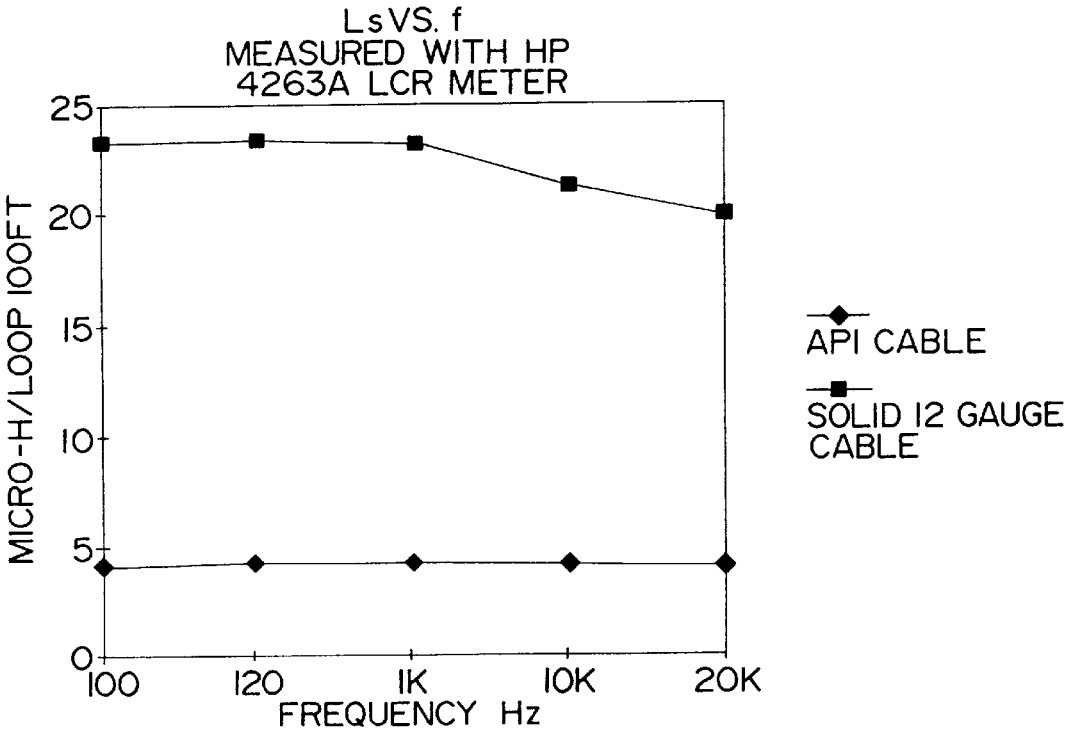
FIG 8

FIG 9
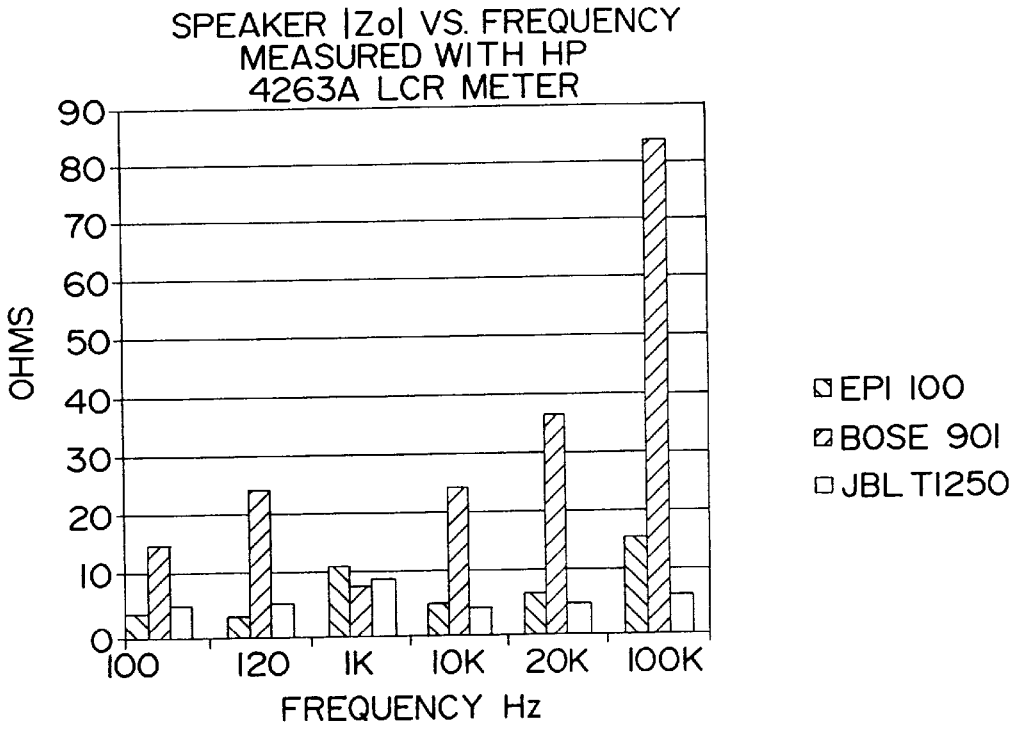
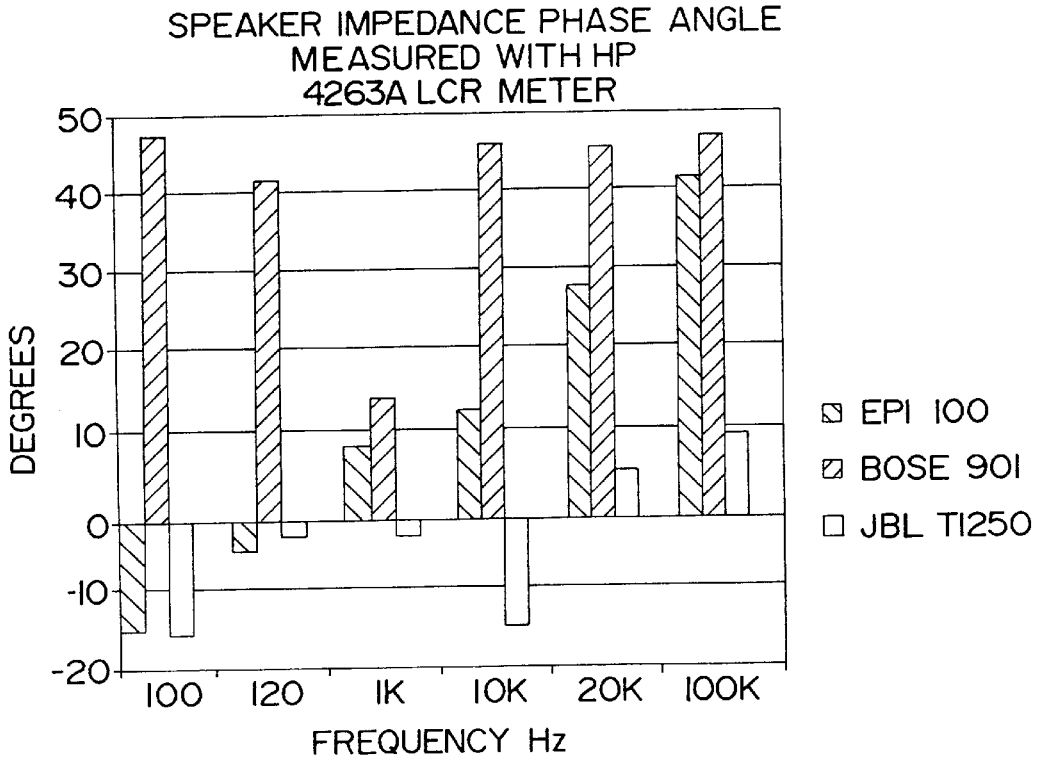
FIG 10

FIG 11
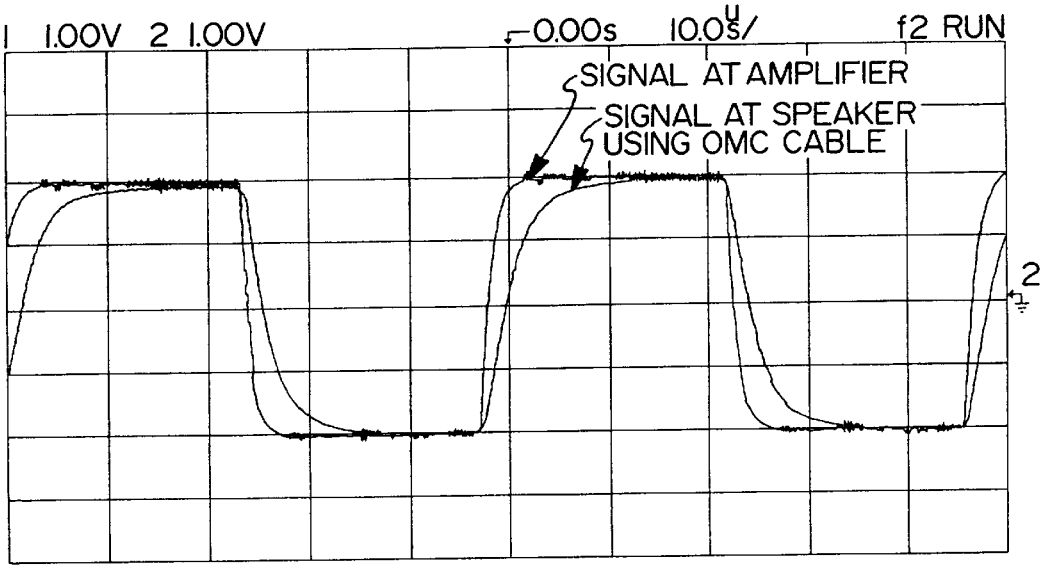
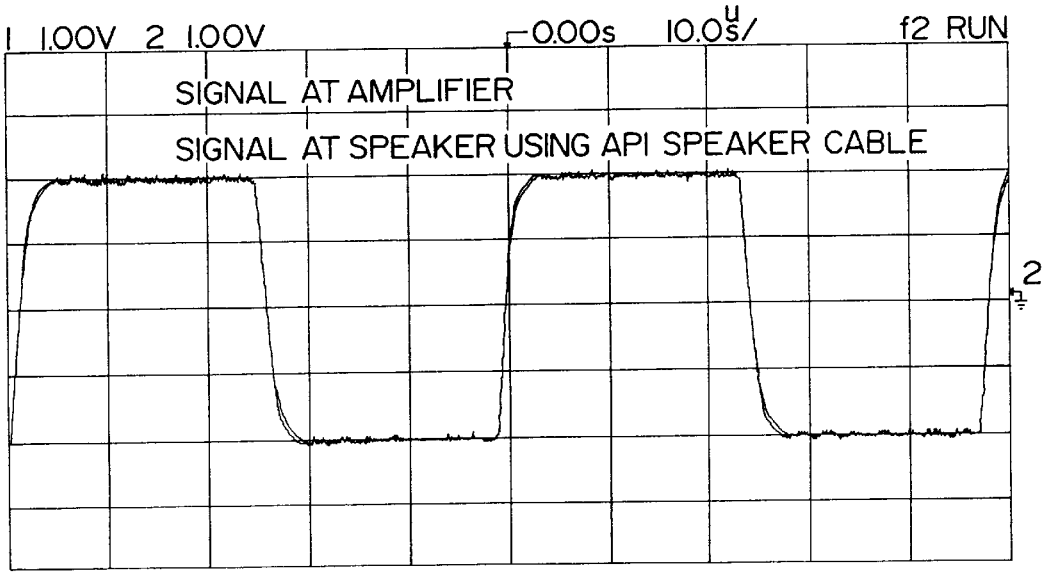
FIG 12

CABLE FOR TRANSMITTING ELECTRICAL IMPULSES

BACKGROUND OF THE INVENTION

1. Field of the Invention

The present invention relates to an insulated wire cable assembly for transmitting electrical power or signals. More particularly, the present invention relates to an insulated wire cable assembly which uses a conductor which has an oval cross-section, which preferably is formed of interwoven filaments, and which allows for improved performance of the cable.

2. Description of the Background Art

Electrical cable is used for many applications, such as power cords, telephone lines, speaker cables, power lines and many other applications. Most electrical cable in use today uses cylindrical conductors which are round in cross-section. Known cable designs have a higher than optimal level of current bunching, skin effect phenomenon, and frequency effects that degrade the performance of the cable.

People tend to think in terms of DC when they think of cable performance. Even experienced electrical engineers will forget about the effects of frequency on cable performance. When using DC, current is uniformly distributed across the entire cross-section of the wire conductor and the resistance is a simple function of the cross-sectional area.

SKIN EFFECT

It is a well-known fact that as frequency increases, the resistance of a conductor increases, due to skin effect. Skin effect describes a condition where, due to the magnetic fields produced by current flowing through a conductor, there is a concentration of current near the conductor surface. As the frequency increases, the current is concentrated closer to the surface. This effectively decreases the cross-section through which the current flows, and therefore increases the effective resistance. See, e.g., Henry W. Ott, *Noise Reduction Techniques in Electronic Systems* (New York, N.Y. John Wiley and Sons, 1988, p. 150).

As the frequency increases the current over the wire cross-section tends to crowd closer to the outer periphery due to skin effect. The current can be assumed to be concentrated in an annulus at the wire surface of thickness equal to the skin depth.

For copper wire the skin depth (6) at selected frequencies is as follows:

60 Hz—$\delta$=8.5 mm 1 kHz—$\delta$=2.09 mm 10 kHz—$\delta$=0.66 mm 100 kHz—$\delta$=0.21 mm.

Note that the skin depth is becoming very small as the frequency increases.

As a result, the center area of the wire is not helping in the performance of the cable as the frequency increase. This can be seen graphically in FIG. 1, in which current density with DC is shown in a cross-section of a cylindrical wire on the left, where $r_w$ represents the radius of the wire. On the right side of the figure, current density at a higher frequency of AC is shown in the same wire as $\delta$, and is limited to a ring on the outside of the cross-sectional view of the wire. The shaded region of the figure represents the current density.

CURRENT BUNCHING

Current bunching is another problem that arises when using two cylindrical conductors to transmit alternating current through an electrical cable. Generally, the term "current bunching" refers to the tendency of current, flowing in two directions through a pair of adjacent conductors, to concentrate in the portions of the conductors which are closest together. For two cylindrical conductors supplying forward current to and returning current from a load, the return current from the load wants to flow as closely as possible to the current flowing to the load. As the frequency increases, the return current wants to flow close to the outgoing current to minimize the loop area. Accordingly, as frequency increases, current flowing through a pair of cylindrical conductors will not be uniform, but will tend to bunch in where the wires are closest together. This can be seen in FIG. 2, which illustrates current density distribution in a cross-sectional view of a pair of cylindrical wires at 20 kHz. The density shadings are labeled A through J in order of increasing current density. The Figure clearly illustrates that the current is densest at the portions of the conductors where they are closest to one another.

This current bunching phenomenon will cause the resistance of the wires to increase with frequency, since less and less of the wire is being used to transmit current. The resistance of the wire is related to its cross-sectional area, and as the frequency increases, the effective cross-sectional area of the wires is-decreasing. As a result, the resistance for typical cable, which uses cylindrical wires therein, changes with frequency.

The following is a summary of some issued U.S. patents relating generally to electrically conductive wiring and cable. No representation is made herein that any of these references constitute prior art with respect to, or have any particular relevance to, the present invention.

U.S. Pat. No. 4,070,911 to Makin discloses a flat braided tape made primarily of a yarn, but which also includes an interwoven carrier means for electricity, light, or fluid. The carrier means may be metallic wires or may be other materials.

U.S. Pat. No. 4,662,693 to Hutter et al. discloses a shielded connector for connecting sections of flat ribbon cable together. The type of cable discussed in the Hutter reference has a plurality of parallel segments located side by side to form a flat ribbon, each of the segments including a central conductor surrounded by a dielectric material, and a single filament wire external to the dielectric surrounding the central conductor, the single filament wire running parallel to the central conductor and alongside thereof.

U.S. Pat. No. 4,734,544 discloses a speaker cable in which a plurality of bundles of wires are arranged around a dielectric core, with the wires making up each bundle being helically twisted in a first direction, while the bundles are helically twisted around the core in a second direction opposite the first direction.

U.S. Pat. No. 4,794,229 to Gosss et al. discloses a flexible heating cable having two staked flat braided electrical conductors housed within electrical heating tape, the conductors being separated by a plurality of positive temperature coefficient thermistors which are placed there between to generate heat for warming pipes of the like. The electrical conductors also serve to dissapate the heat generated by the thermistors.

U.S. Pat. No. 5,393,933 to Goertz discloses a speaker cable composed of two solid rectangular conductors sandwiched together with a thin interlayer of a dielectric material.

Although various designs exist for specialized applications of electrical wiring, as noted, a need still exists in the art for an electrical transmission cable assembly having improved performance characteristics. In particular, a cable assembly which will minimize the phenomena of skin effect and current bunching would be beneficial.

SUMMARY OF THE INVENTION

The present invention provides an electrically conductive cable for transmitting electrical impulses, the cable including vertically stacked conductors which are substantially oval in cross-section. A cable according to a first embodiment of the present invention, generally, includes a first braided wire conductor surrounded by a dielectric material, and a second braided wire conductor, which is stacked vertically above the first conductor.

In a preferred version of the first embodiment hereof, the cable includes a first flattened wire conductor having a cross-sectional height and a cross-sectional width which is more than twice the cross-sectional height, the first conductor having rounded shoulders at opposite side edges thereof, and a first dielectric sheath surrounding the first flattened wire conductor. The cable also includes a second flattened wire conductor which has a cross-sectional height and a cross-sectional width which are substantially identical to those of the first flattened wire conductor, the second conductor also having rounded shoulders at opposite side edges thereof, and being stacked vertically above the first conductor to enhance performance characteristics of the cable.

In a modified version of the first embodiment of the present invention, optionally, a shielding tube may be provided surrounding the wire conductors and their associated dielectric sheaths.

In a second embodiment of the present invention, a cable assembly hereof, generally, includes a substantially tubular first wire conductor having an oval cross-section. The first conductor may have an insulator disposed therein, and also is surrounded by a first tubular sheath formed of dielectric material. The first wire conductor is preferably formed of braided individual wire filaments. The cable assembly also includes a second wire conductor having an oval cross-section, which may also have an insulator therein. The second conductor is also preferably surrounded by a dielectric material, and is stacked vertically above the first conductor.

In a modified version of the second embodiment of the present invention, a third wire conductor may be provided, surrounding the first and second conductors and their associated dielectric sheaths, for applications requiring electromagnetic shielding, or requiring a safety ground (e.g. three plug power cords).

Cables according to the present invention can be made for use as high-fidelity speaker wires. In addition, cables according to the present invention can be made for conducting normal household alternating current.

Accordingly, it is an object of the present invention to provide a wire cable assembly having improved performance characteristics.

It is a further object of the present invention to provide a wire cable assembly which minimizes the change of resistance and inductance with frequency.

It is yet a further object of the present invention to provide a wire cable assembly which resists the phenomenon of current bunching.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 1 is a cross-sectional view of two different cylindrical conductors, showing the phenomenon of skin effect, at higher frequencies of alternating current, in the conductor shown on the right;

FIG. 4 is a top plan view of a portion of a conductor which is part of the cable assembly of FIG. 3;

FIG. 5 is a cross-sectional view of a cable assembly in accordance with a modified version of the first embodiment of the present invention;

FIG. 6 is a cross-sectional view of a cable in accordance with a second embodiment of the present invention;

FIG. 7 is a graph of frequency vs. resistance, showing the performance of two cables, where the API cable is the oval braided cable of the invention and the other cable is a commercially available 12 gauge wire cable with solid cylindrical conductors surrounded by a dielectric;

FIG. 8 is a graph of frequency vs. inductance, comparing the performance of two cables, where API cable is a cable according to the present invention, while the other cable is a commercially available 12 gauge wire cable with solid cylindrical conductors surrounded by a dielectric;

FIG. 9 is a bar graph of inductance vs. frequency;

FIG. 10 is a bar graph of impedance phase angle vs. frequency;

FIGS. 11 and 12 are comparative oscilloscope readouts of AC signals at an amplifier overlaid with the signals received at a speaker, differences in the sent and received signals representing signal losses through the transmission cable;

FIG. 14 is a cross-sectional view of a connector and cable according to the present invention, and FIG. 15 depicts an alternate mode for connecting the cable to a speaker.

DETAILED DESCRIPTION OF THE PREFERRED EMBODIMENT

Figure 2:
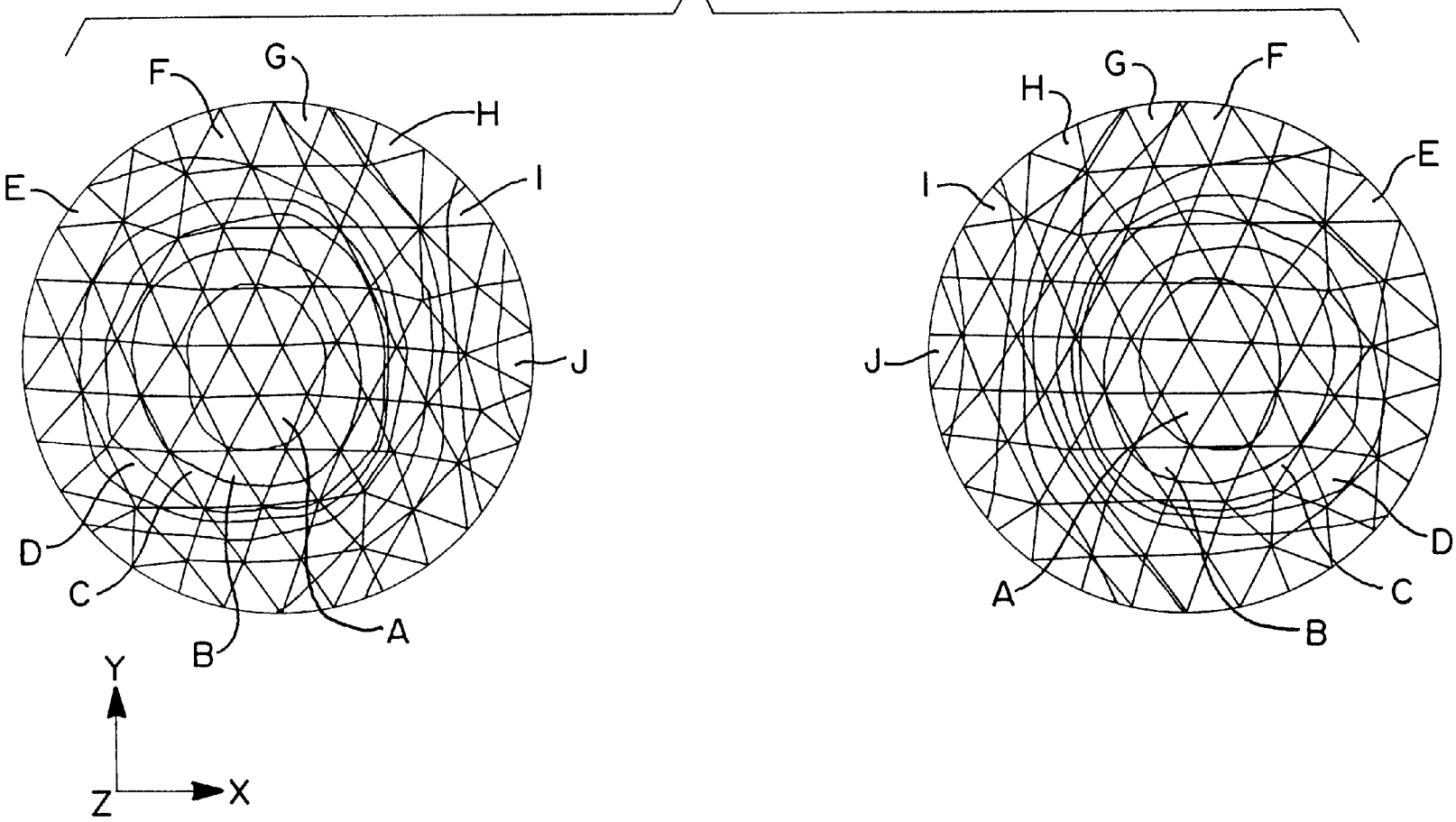
FIG. 2 is a cross-sectional view of a prior art speaker cable, showing the distribution of current density within conductive wires of the cable at a particular frequency of alternating current.
Figure 3:
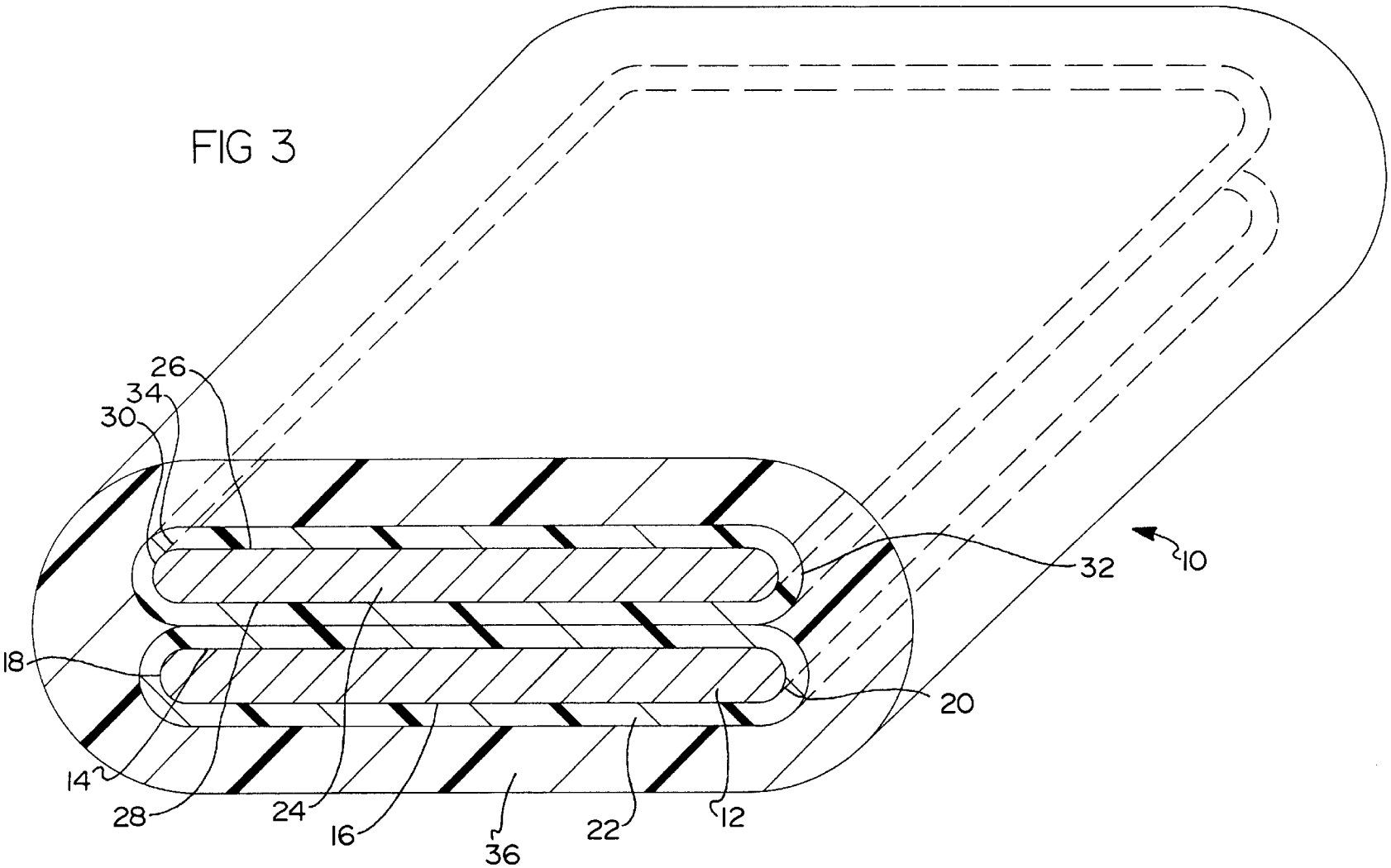
FIG. 3 is a perspective view of a section of a cable in accordance with a first embodiment of the present invention.

Referring now to FIG. 3 of the drawings, a section of a cable assembly according to a first embodiment of the present invention can be seen generally at 10. The cable assembly 10 includes a first braided wire conductor 12 having an oval cross-section, with a cross-sectional height and a cross-sectional width which is more than twice the cross-sectional height. Preferably, the first conductor 12 is flattened to such an extent that the width is many times the height thereof. The first conductor 12 is substantially flat on the top and bottom surfaces 14, 16 thereof, and has rounded shoulders 18, 20 at opposite sides thereof. The first conductor 12 is made up of a plurality of individual filaments 15 which are interwoven or braided together in a non-linear pattern, meaning that not all of the filaments 15 are parallel to one another. While many different patterns are possible, one illustrative pattern is shown in FIG. 4.

A first dielectric sheath 22 is provided surrounding the first conductor 12. The preferred dielectric material for use in the cable 10 according to the present invention is polyethylene, or a variant thereof, because of its high dielectric constant and relative flexibility. Other dielectric materials are suitable and may be used, and many dielectric materials are known and are commercially available.

The cable also includes a second flattened wire conductor 24 which is substantially identical to the first flattened wire conductor 12 as described herein, being generally oval in cross-section, and having a cross-sectional height and a cross-sectional width which is more than twice the cross-sectional height. The second conductor 24 is substantially flat on the top and bottom surfaces 26, 28 thereof, and has rounded shoulders 30, 32 at opposite sides thereof. A second dielectric sheath 34 may, optionally, be provided surrounding the second flattened wire conductor. Alternatively, the second dielectric sheath 34 may be omitted, and the second conductor 24 may be placed directly on top of the first dielectric sheath 22.

Whether or not the second dielectric 34 is used, an external dielectric sheath 36 is required and surrounds both the first and second conductors 12, 24 to insulate them from the surroundings. A preferred dielectric material is polyethylene chloride.

In the preferred cable design, the second flattened wire conductor 20 is disposed vertically above the first flattened wire conductor 12, as shown, to enhance performance characteristics of the cable 10. It has been found, surprisingly, that flattening out the conductors 12, 24 and stacking them vertically, as shown, greatly decreases the influence of current bunching. Current bunching is reduced in the cable 10 according to the present invention because now the closest portions of the conductors to one another have much greater area than would be the case using conventional cylindrical conductors.

If the filaments 15 of the braided wire conductors 12, 24 are woven into a pattern where every wire is statistically as close to the return current as every other wire, that is, where every strand of the wire is woven to move up and down through the conductor as a whole, having parts close to the bottom of the conductor and parts close to the top thereof, each strand now has the same inductance as every other strand. The current density will now be evenly distributed between the strands, and overall the wire will behave much like a solid cylindrical wire operating with direct current. Using braided flat wire conductors as described, we have found unexpectedly that you do not need to coat each strand with a film insulation as in some other wires which are very expensive to produce. More importantly, by having two flattened conductors closely spaced, we have provided a wide return path, simply from the geometry of the wire, which eliminates the current bunching very effectively. As a result, the cable 10 according to the present invention exhibits much more constant resistance over different frequencies than the currently available cables.

Electromagnetic Interference (EMI) is commonly encountered when multiple electronic devices are operated concurrently in close proximity to one another. Almost everyone has heard and/or seen the effect of a vacuum cleaner, a lawn mower engine, a hair dryer, or a blender interfering with a radio or television. These are examples of EMI. As discussed on page 29 of Henry W. Ott's *Noise Reduction Techniques in Electronic Systems*, cited hereinabove, cables are important because they are the longest parts of a system and therefore act as antennae that pick up and/or radiate noise. While all real-world cables fall short of ideal behavior, it is a goal of the present invention to make a cable which performs closer to ideal than other cables currently available. The conductors of a system, while frequently overlooked, are important components of the total system. Perhaps one of the most important effects, at least in digital circuits, is conductor inductance. The cable 10 according to the present invention exhibits very low inductance which helps reduce noise picked up, and to improve the final sound.

Referring now to FIG. 5, a modified version of the first embodiment of a cable assembly 110 in accordance with the present invention is shown in cross-section. Like the cable assembly 10 according to FIG. 3, this cable 110 has a flattened first conductor 112 which is oval in cross-section and which is formed of individual filaments which are interwoven or braided into a non-linear pattern. The first conductor 112 is surrounded by a first dielectric sheath 122, and a flattened second conductor 124, which is substantially identical to the first conductor 112, is disposed a short distance vertically above the first conductor 112 and may, optionally, be surrounded by a second dielectric sheath 134. Also like the first embodiment, an external dielectric sheath 136 is required and surrounds both the first and second conductors 112, 124 to insulate them from the surroundings.

However, in this modification of the first embodiment, a metal shielding tube 140 is provided surrounding the first and second conductors 112, 124 and their respective dielectric sheaths 122, 134. The shielding tube 140 is located inside the external sheath 136 and helps to prevent signal interference from other electromagnetic fields outside the cable 110. The shielding tube 140 may be formed of a metal foil, or may also be formed of individual filaments interwoven together into a non-linear pattern.

Referring now to FIG. 6 of the drawings, a section of a cable assembly according to a second embodiment of the present invention can be seen generally at 210. The cable assembly 210 includes a first wire assembly 212, a second wire assembly 214 which is substantially identical to the first wire assembly and which is stacked vertically thereon, and a dielectric sheath 216 which surrounds and houses the first and second wire assemblies 212, 214.

The first wire assembly 212 includes a first central insulator 218 which is surrounded by a first substantially tube-shaped wire conductor 220. The first conductor 220 is oval in cross-section, as shown, and is preferably made up of a plurality of fine hairlike individual wire filaments similar to that shown at 15 which are braided, or interwoven, into a non-linear pattern, as shown in FIG. 4 and as discussed in connection with the first embodiment 10 hereof. The braided nature of the conductor 220 provides superior current distribution, as well as superior flexibility and mechanical strength as compared to solid metal.

The advantage of using a tubular shape for the conductor 220, with a substantially oval cross-section, as shown, is that this shape minimizes skin effect and current bunching and therefore promotes improved performance of the cable assembly 210, as will be further discussed hereinbelow.

The first wire assembly 212 also includes a first dielectric sheath 222 surrounding and housing the first conductor 220 to insulate it from its immediate surroundings.

The second wire assembly 214 includes a second central insulator 224, which is surrounded by a second substantially tube-shaped wire conductor 226, which is substantially identical to the first conductor 220. The second conductor 226 is oval in cross-section, as shown, and is preferably made up of a plurality of fine hairlike individual wire filaments similar to that shown at 15 which are braided, or interwoven, into a non-linear pattern, as shown in FIG. 4 and as discussed in connection with the first embodiment 10 hereof. The braided nature of the conductor 220 provides superior current distribution, as well as superior flexibility and mechanical strength as compared to solid metal.

Figure 6A:
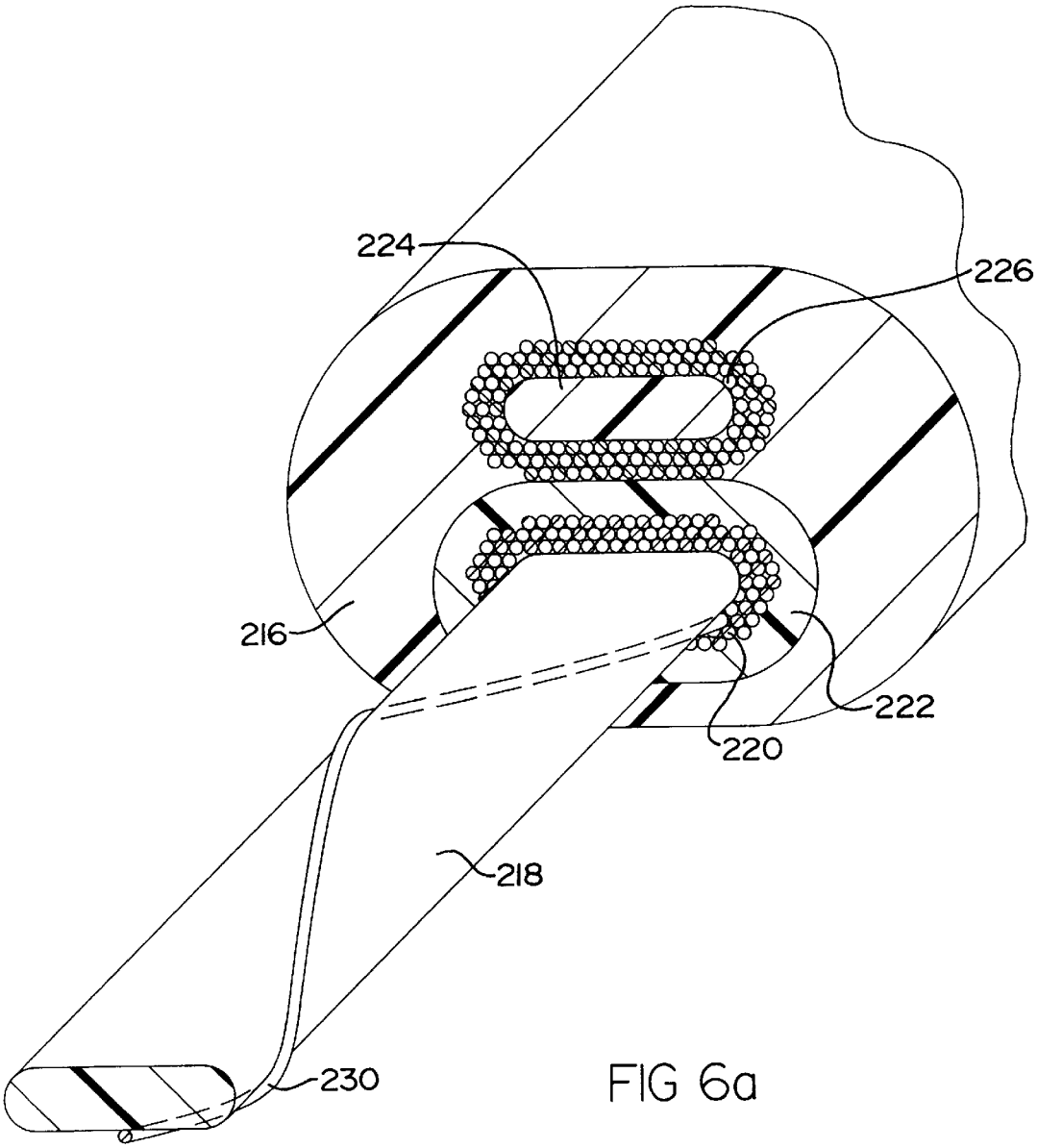
FIG. 6*a* is a perspective view, partly in cross-section, of a cable in accordance with the present invention.

The second wire assembly 214 may, also, include a second dielectric sheath 228 surrounding and housing the second conductor 226 to insulate it from its immediate surroundings, or alternatively and as shown in FIG. 6*a*, the second dielectric sheath 228 may be omitted, so long as the first dielectric sheath 222 surrounding the first conductor 220 is provided.

In any case, the cable assembly 210 includes an outer dielectric sheath 216, as noted, to house and protect both the first and second wire assemblies 212, 214.

As noted above in the background section, from FIG. 1 we can see the general rule that at DC the current is uniformly distributed across the cross-section of the wire conductor, but as the frequency gets higher the current is distributed near the surface thereof. The center part of the conductor is not used at high frequencies, so we can simply eliminate it. We could use a cross-sectionally annular or ring-shaped conductor, but an oval is better as we will discuss below. By using a hollow conductor we help minimize the change in resistance with frequency.

We do not want to use a cross-sectionally rectilinear or rectangular conductor, because we would have high electric field values caused by the sharp corners. High electric fields can break the dielectric down causing a failure of the cable. Also the sharp corners from rectangular conductors can increase the stress and chafing on both the conductor and the dielectric from mechanical flexing of the cable, and can lead to a short or to an open circuit. A cross-sectionally oval conductor eliminates these concerns by virtue of the round corners.

The advantage of an oval vs. round cross-section is that the oval shape helps reduce current bunching. The oval shape allows more of the return current to be closer to the outgoing current, thus reducing current bunching.

By using a braided conductor instead of a solid conductor, we have a more mechanically sound cable. A woven or braided cable is more flexible and resistant to a stress fracture from continual flexing of the cable than a solid cable. A braided wire is easier to fit standard connectors to then a solid because the flexibility of the braid allows one to form it into the shape of the connector.

As noted above in connection with the first embodiment, when using a braided wire made up of smaller conductors which are woven into a pattern where every wire, one of which is particularly shown at 228, is statistically as close to the return current as every other wire, that is, where every strand of the wire is woven to move up and down through the conductor as a whole, having parts close to the bottom of the conductor and parts close to the top thereof, each strand now has the same loop area as every other strand. The current density will now be more evenly distributed between the strands, and overall the wire will behave much like a solid cylindrical wire operating with direct current. Using a braided oval conductor as described, we have found that you do not need to coat each stand with film insulation as is some other wires which are expensive to produce. As a result, the cable assembly 210 according to the present invention exhibits much more constant resistance over different frequencies than currently available cables, as can be seen in the graph of FIG. 7, in which API cable is the cable according to the present invention. Also as a result, the cable assembly 210 according to the present invention exhibits much more constant inductance over different frequencies than other cables, as can be seen in the graph of FIG. 8, in which API cable is the cable according to the present invention.

We have been discussing resistance because it is a very important characteristic of a conductor. Selection of a conductor size is generally determined by the maximum allowable voltage drop in the conductor. The voltage drop is a function of the conductor resistance and maximum current. Another parameter discussed in cable design is the characteristic impedance of a cable. It is import to give the frequency range when you discuss the characteristic impedance. A quote from Malcolm Hawksford, which appeared in *HI-FI NEWS & RECORD REVIEW*, February 1987 summaries this point, "Another area of neglect (or rather ignorance) concerns cable matching effects. In the literature on cables, the characteristic impedance is often quoted as a real number, for example 50 ohm or 75 ohm. This figure is applicable when the signal frequency is sufficiently high that the inductance and capacitance dominate the expression for $Z_o$; but at audio frequencies it is simply not correct and the more general complex impedance for $Z_o$ must be used an expression where the conductor resistance dominates over the inductive reactance. Consequently, the idea of using a transmission-line fed from, say 75 ohm and terminated in 75 ohm is unfounded, as an evaluation of $Z_o$ will reveal, even though matching is advantageous at hf . . . " The Table below shows that the impedance of a cable is not constant over the audio range. This data is also shown graphically in FIG. 9.

TABLE CONTAINS MEASURED DATA USING HP 4263A LCR METER

| $\lvert Z_o \rvert$ VS. FREQUENCY | 100 HZ | 120 HZ | 1K HZ | 10K HZ | 20K HZ |
|---|---|---|---|---|---|
| API CABLE (Ω) | 123.1 | 112.96 | 39.98 | 17.47 | 16.42 |
| SOLID 12 GAUGE CABLE (Ω) | 206.9 | 190.7 | 81.3 | 69.7 | 69.0 |

The characteristic impedance of a cable is given by $Z=[(R+j\omega L)/(G+j\omega C)]^{1/2}$ where R is the series resistance, L is the series inductance, G is the shunt conductance, C is the shunt capacitance, and ω is the angular frequency. Note that this is not a simple number for a cable but will change with frequency. It is also important to note that R, L, G and C will change with frequency making the impedance of a cable even more frequency dependent.

Z is a complex number and people like to simply things by assuming a lossless transmission line and assume that R and G are zero. This may be a valid approximation at microwave frequency but is not valid at low frequencies if you want an accurate model of a cable. For example to say that a speaker cable has an impedance of 10 ohms is not true from 0 to 20,000 Hz. It is also not true that the speaker impedance is constant over the audio frequency range as the table below shows. When you say a speaker is 8 ohms it is usually stated at a fixed frequency and you are ignoring the imaginary part since the impedance is really a complex number as the table below shows. This data is also shown graphically in FIG. 10.

MEASURED SPEAKER IMPEDANCE WITH A HP 4632A LCR METER

| | 100 HZ | 120 HZ | 1K HZ | 10K HZ | 20K HZ |
|---|---|---|---|---|---|
| EPI 100 (Ω) | 4.54 ∠ −13.8 | 4.43 ∠ −3.84 | 12.84 ∠ +9.81 | 6.26 ∠ +13.85 | 8.01 ∠ +29.21 |
| BOSE 901(Ω) | 16.5 ∠ +49.1 | 26.3 ∠ +43.4 | 8.72 ∠ +15.9 | 26.4 ∠ +47.5 | 38.3 ∠ +47.2 |
| JBL T1250 (Ω) | 6.17 ∠ −14.4 | 6.42 ∠ −2.15 | 10.38 ∠ −2.1 | 5.22 ∠ −13.4 | 6.10 ∠ +6.41 |

You must define the frequency region you are in when you discuss the cable impedance. For DC ($\omega=0$), $Z=(R/G)^{1/2}$ is very high since G is small (e.g. G=1.4 $\mu$S/loop mile).

For the low frequencies ($\omega L \ll R$), and G is very small for lines with good insulation. The impedance is then $Z=[R/(2\omega C)]^{1/2}-j[R/(2\omega C)]^{1/2}$ and the impedance appears capacitive at low frequencies. The velocity at which an ac wave and its accompanying electric and magnetic fields are propagated can be evaluated by the expression for the phase velocity, $v_p=[(2\omega)/(RC)]^{1/2}$. The variation of phase velocity with frequency causes distortion of the signal as it progresses down a transmission line, as the higher-frequency components travel down a line faster than do the low-frequency components. From this we can see that we will have distortion. Since the angular frequency ($\omega$) cannot be controlled, minimization of the frequency dependence of R, as shown in the graph of R vs. f in FIG. 7 is critical to reduction of distortion. Our design also minimizes the frequency dependence of the inductance L, as shown by the graph of FIG. 8. By minimizing current bunching we will thus minimize the distortion.

The cable according to the present invention minimizes distortion of a signal passing therethrough, as can be seen from a comparison of FIGS. 11 and 12. FIG. 11 is a plot of two overlaid traces from a Hewlett-Packard digital oscilloscope, where the signal is shown at the amplifier and at the speaker after traveling through 100 feet of commercially available wire cable with cylindrical conductors surrounded by a dielectric. From FIG. 11 we can see that the signal at the speaker is not the same as the signal at the amplifier, and therefore we can see that the signal has been distorted by the cable.

FIG. 12 is also a plot of two overlaid traces from a Hewlett-Packard digital oscilloscope, where the signal is shown at the amplifier and at the speaker after traveling through 100 feet of API cable according to the present invention. From FIG. 12, we can see that the signal at the speaker is essentially the same as the signal at the amplifier, and we can see that the cable according to the present invention has minimized any distortion introduced by the transmission cable.

For very high frequencies $\omega L \gg R$ , and $\omega C \gg G$ with G negligible anyway. And $Z_o=(L/C)^{1/2}$. It is this impedance that manufactures usually quote when specifying the characteristic impedance of a line, that is 300Ω TV cable, 75Ω coaxial cable, and so on. See, e.g., William Sinnema, *Electronic Transmission Technology* (Englewood Cliffs, N.J., Prentice Hall, 1988, p. 53)

Electromagnetic Interference (EMI) is commonly encountered when multiple electronic devices are operated concurrently in close proximity to one another. Almost everyone has heard and/or seen the effect of a vacuum cleaner, a lawn mower engine, a hair dryer, or a blender interfering with a radio or television. These are examples of EMI. As discussed on page 29 of Henry W. Ott's *Noise Reduction Techniques in Electronic Systems*, cited hereinabove, cables are important because they are the longest parts of a system and therefore act as antennae that pick up and/or radiate noise. While all real-world cables fall short of ideal behavior, it is a goal of the present invention to make a cable which performs closer to ideal than other cables currently available. The conductors of a system, while frequently overlooked, are important components of the total system. To reduce EMI it is important to have a low inductance. The cable 210 according to the present invention exhibits low inductance which helps reduce noise picked up, and to improve the final sound. The shield around the conductors will also further reduce EMI.

Figure 13:
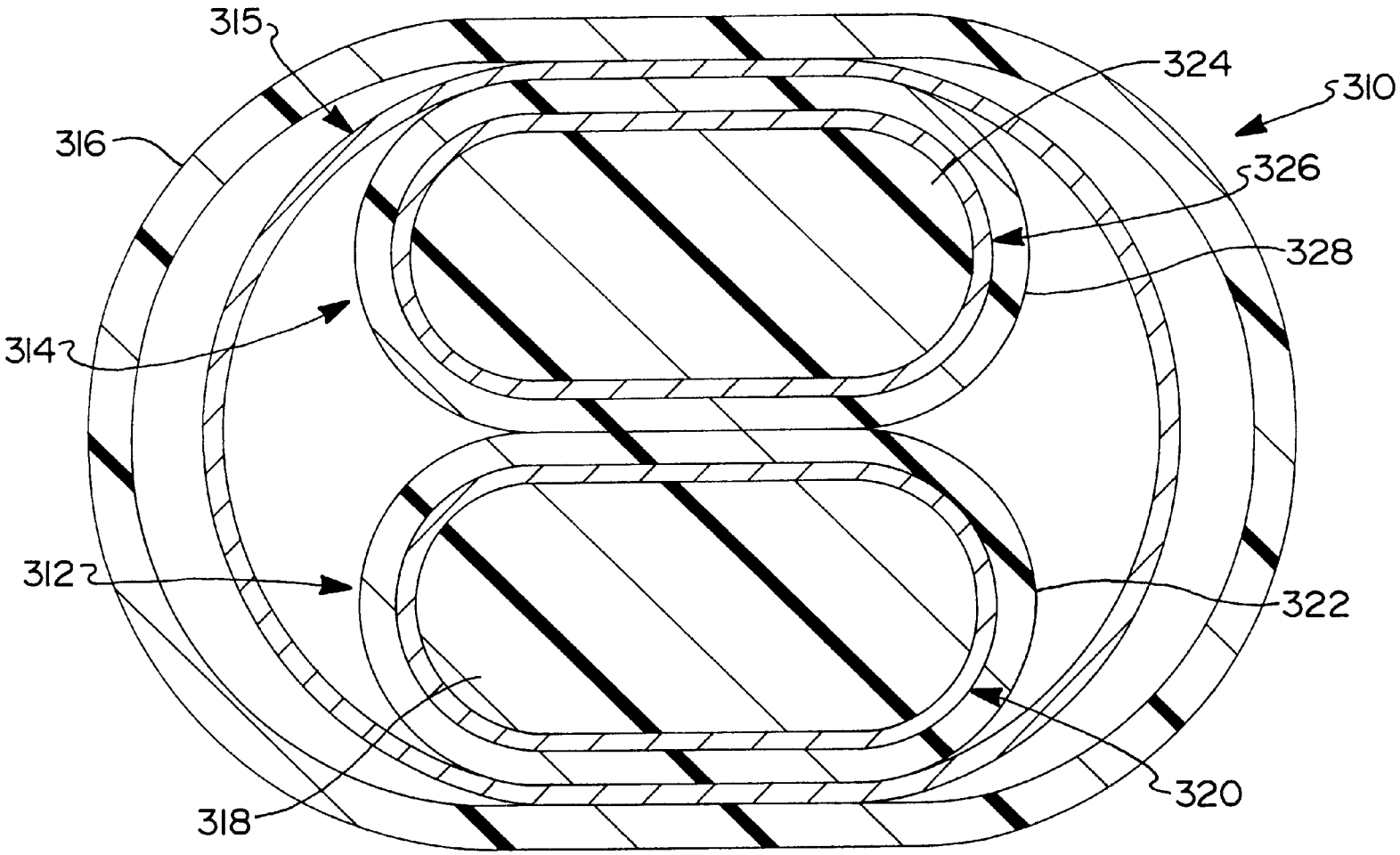
FIG. 13 is a cross-sectional view of a cable in accordance with a variation of the embodiment of FIG. 6 according to the present invention.

Referring now to FIG. 13, a variation of the second embodiment of a cable assembly 310 in accordance with the present invention is shown in cross-section. Like the cable 210 according to the second embodiment, this cable 310 includes a first wire assembly 312, a second wire assembly 314 which is stacked vertically on top of the first wire assembly 312, and an external dielectric sheath 316 which surrounds and houses the first and second wire assemblies 312, 314. Unlike the cable 210 according to the second embodiment, however, the cable 310 has a metallic shielding tube 315 disposed between the external dielectric sheath 316 and the wire assemblies 312, 314, as shown.

The first wire assembly 312 is substantially identical to the first wire assembly 212 of FIG. 6, and includes a cross-sectionally oval first insulator 318 surrounded by a tubular braided first conductor 320 which is oval in cross-section, as shown. The first conductor 320 is in turn surrounded by a first dielectric sheath 322.

In a similar fashion, the second wire assembly 314 is substantially identical to the second wire assembly 214 of FIG. 6, including a second insulator 324 surrounded by a tubular braided second conductor 326 having an oval cross-section. The second conductor may, optionally, be surrounded by a second dielectric sheath 328, but the second dielectric sheath is not required so long as the first dielectric sheath 322 is present. In this variation of the second embodiment, an external dielectric sheath 316 is required and surrounds both the first and second conductors 320, 326 and their respective dielectric sheaths 322, 328. The shielding tube 315 is located inside the external sheath 316, and helps to prevent signal interference from other electromagnetic fields outside the cable 310.

For large gauge oval braided conductors, a custom connector 410 as shown in FIG. 14 will allow the cable to be connected to the speaker and amp. The connector 410 is shown hooked to a cable assembly 210 similar to that shown in FIG. 6. Initially, the dielectric material from the outer dielectric sheath 216 is removed in the area of the cable 210 to be connected to the connector 410. Then, material is removed from the first dielectric sheath 222 at the bottom of the first wire assembly 212 to expose the metallic bottom surface of the first conductor 220, and material is removed from the second dielectric sheath 228 at the top of the second wire assembly 214 to expose the metallic top surface of the second conductor 226. Then, the exposed end of the cable assembly is placed into the connector 410 between opposed metal top and bottom jaws 412, 414 thereof, and a pair of insulated screws 416 are rotated to tighten the connector 410 in place on the cable 210. Top and bottom banana plugs 418, 420 are in electrical communication with the top and bottom jaws 412, 414, respectively, and may be hooked up to the speaker (not shown) in conventional fashion.

Referring now to FIG. 15, an alternative method of connecting the cable according to the present invention to a speaker will be discussed. FIG. 15 shows a section of a conductor 512 which is similar to that shown at 12 in FIG. 3. The dielectric is not shown in FIG. 15, but would be stripped away from the end of the conductor for a desired distance. An end portion 514 of the conductor 512 is flattened and is then dipped in, or coated with, an electrically conductive solder. A U-shaped piece is then cut out of the end portion 512 with a mechanical punch, leaving a slot 516 formed in the conductor end with two prongs 518, 520 remaining on either side of the slot 516. The conductor end 514 is then slid underneath a fastener 522 at the back of a speaker, and the fastener 522 is then tightened down on the prongs 518, 520 to hold the conductor 512 in place and to establish a good electrical contact therewith.

While the advantages of the cable design according to the present invention are particularly clear as applied to audio speaker cable, which is the example used throughout the specification, it is believed that advantages of the cable design according to the present invention are not limited to speaker cables, but would be widely applicable to electrical power cables generally in which pairs of conductors are used.

Although the present invention has been described herein with respect to specific and preferred embodiments thereof, it will be understood that the foregoing description is intended to be illustrative, and not restrictive. Many modifications of the present invention will occur to those skilled in the art. All such modifications which are within the scope of the appended claims are intended to be within the scope and spirit of the present invention.

Having, thus, described the invention, what is claimed is:

1. An electrically conductive cable having a length, the cable comprising:

a first braided wire conductor comprising a plurality of wires, the first braided wire conductor having a substantially oval cross-section with a cross-sectional height and a cross-sectional width which is more than twice the cross-sectional height the first braided wire conductor having a top portion and a bottom portion;

a first insulator disposed within the first braided wire conductor, eh wire of the first braided wire conductor being twisted about the first insulator;

a first dielectric sheath surrounding the first braided wire conductor;

a second braided wire conductor having a substantially oval cross-section with a cross-sectional height and a cross-sectional width which are substantially identical to those of the first braided wire conductor, a second insulator disposed within the second braided wire conductor, each wire of the second braided wire conductor being twisted about the second insulator, the second braided wire conductor having a top portion and a bottom portion;

the second braided wire conductor being disposed vertically above the first braided wire conductor; and wherein each wire of the first braided wire conductor has a substantially equal number of sections proximate the bottom portion of the first braided wire conductor and a substantially equal number of sections proximate the top portion of the first braided wire conductor over the length of the electrically conductive cable.

2. The cable of claim 1 wherein each wire of the second braided wire conductor has a substantially equal number of sections proximate the bottom portion of the second braided wire conductor and a substantially equal number of sections proximate the top portion of the second braided wire conductor.

3. The cable of claim 2 wherein the first conductor and the second conductor are each adapted for transferring electrical signals in the audio frequency range along the length of the cable.

4. The cable of claim 2, wherein the cable has an end portion with a U-shaped slot formed therein to connect to a load.

5. The cable of claim 4, wherein the end portion of the cable is coated with solder.

6. The cable of claim 1 further comprising an outer dielectric sheath surrounding the first dielectric sheath and the second braided wire conductor.

7. The cable of claim 1 further comprising a second dielectric sheath surrounding the second braided wire conductor.

8. An electrically conductive cable having a length, the cable comprising:

a first braided wire conductor comprising a plurality of wires, the fir braided wire conductor having a substantially oval cross-section with a cross-sectional height and a cross-sectional width which is more than twice the cross-sectional height;

a first dielectric sheath surrounding the first braided wire conductor, a second braided w conductor comprising a plurality of wires, the second braided wire conductor having a substantially oval cross-section with a cross-sectional height and a cross-sectional width which are substantially identical to those of the first braided wire conductor, the second braided wire conductor being disposed vertically above the first braided wire conductor; and wherein each wire of the plurality of wires of the first braided wire conductor moves up and down through the first conductor, each wire of the plurality of wires of the first braided wire conductor having a number of sections disposed proximate the bottom portion of the first braided wire conductor and a statistically equal number of sections of each wire proximate the top portion of the first braided wire conductor over the length of the electrically conductive cable.

9. The cable of claim 8 wherein the first conductor and the second conductor are each adapted for transferring electrical signals in the audio frequency range along the length of each conductor.

10. The cable of claim 8, further comprising a first insulator disposed within the first conductor, and a second insulator disposed within the second conductor.

11. The cable of claim 10, wherein the first and second insulators are substantially oval in cross section.

* * * * *